US008584908B2

(12) United States Patent
Kakuta

(10) Patent No.: US 8,584,908 B2
(45) Date of Patent: Nov. 19, 2013

(54) DEPRESSION HEAD FOR PUMP AND DEPRESSION HEAD TYPE DISCHARGE PUMP

(75) Inventor: Yoshiyuki Kakuta, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 216 days.

(21) Appl. No.: 13/055,530

(22) PCT Filed: Oct. 26, 2009

(86) PCT No.: PCT/JP2009/068349

§ 371 (c)(1),
(2), (4) Date: Jan. 24, 2011

(87) PCT Pub. No.: WO2010/050441

PCT Pub. Date: May 6, 2010

(65) Prior Publication Data

US 2011/0121037 A1 May 26, 2011

(30) Foreign Application Priority Data

Oct. 31, 2008 (JP) ..... 2008-282473
Oct. 22, 2009 (JP) ..... 2009-243594

(51) Int. Cl.
*B67D 7/58* (2010.01)

(52) U.S. Cl.
USPC ..... 222/380; 222/321.9; 222/321.1

(58) Field of Classification Search
USPC ..... 222/321.9, 380, 321.1, 321.7, 341, 222/321.2, 385, 333, 559, 256; 417/559
See application file for complete search history.

(56) References Cited

U.S. PATENT DOCUMENTS 4,017,031 A * 4/1977 Kishi et al. ..... 239/333
4,317,531 A * 3/1982 Saito et al. ..... 222/321.2

(Continued)

FOREIGN PATENT DOCUMENTS

CN 1596154 3/2005
JP A-9-142517 6/1997

(Continued)

OTHER PUBLICATIONS

International Search Report in International Application No. PCT/JP2009/068349; dated Jan. 26, 2010 (with English-language translation).

(Continued)

*Primary Examiner* — Kevin P Shaver
*Assistant Examiner* — Christopher Luzecky
(74) *Attorney, Agent, or Firm* — Oliff & Berridge, PLC

(57) ABSTRACT

A discharge pump equipped with a push-down head in which a nozzle is opened and closed by advancing and retracting a valve rod member by a lever member and a first pressing member, wherein a second pressing member is provided between the base and the tip of the valve rod member to prevent back flow of air. A push-down head discharge pump has a head body configured by providing a liquid flow pipe to the lower surface of a laterally facing cylinder section so as to extend vertically downward from the lower surface, the liquid flow pipe communicating with a stem of a discharge pump, the cylinder section having a nozzle opened at the front thereof. When the head body is pushed down, a valve rod member mounted in the cylinder section is advanced and retracted. The valve rod member is composed of the base and the tip, and a second pressing member is mounted between the base and the tip.

7 Claims, 8 Drawing Sheets

(56) References Cited

U.S. PATENT DOCUMENTS

| | | | | |
|---|---|---|---|---|
| 5,092,495 | A * | 3/1992 | Andre | 222/341 |
| 5,505,343 | A * | 4/1996 | Knickerbocker | 222/321.1 |
| 5,558,258 | A * | 9/1996 | Albini et al. | 222/496 |
| 5,624,055 | A * | 4/1997 | Clanet et al. | 222/135 |
| 5,769,325 | A * | 6/1998 | Jouillat et al. | 239/337 |
| 5,918,778 | A * | 7/1999 | Schultz | 222/321.7 |
| 6,059,151 | A * | 5/2000 | Fuchs | 222/321.6 |
| 6,471,097 | B2 * | 10/2002 | Hermouet et al. | 222/321.2 |
| 6,824,021 | B2 * | 11/2004 | Masuzzo et al. | 222/321.7 |
| 6,991,137 | B2 * | 1/2006 | Schultz | 222/377 |
| 7,048,155 | B2 * | 5/2006 | Kuwahara et al. | 222/321.9 |
| 7,780,044 | B2 * | 8/2010 | Leuliet et al. | 222/321.9 |
| 7,934,626 | B2 * | 5/2011 | Choi et al. | 222/320 |
| 8,083,159 | B2 * | 12/2011 | Leuliet et al. | 239/337 |
| 8,245,884 | B2 * | 8/2012 | Byeon | 222/256 |
| 8,245,887 | B2 * | 8/2012 | Ohshima | 222/383.1 |
| 2004/0256414 | A1 * | 12/2004 | Graf | 222/321.1 |
| 2005/0006411 | A1 * | 1/2005 | Kuwahara et al. | 222/321.1 |
| 2005/0211798 | A1 * | 9/2005 | Garcia et al. | 239/333 |
| 2006/0151541 | A1 * | 7/2006 | Pares Montaner et al. | 222/321.2 |
| 2008/0017666 | A1 * | 1/2008 | Vanblaere et al. | 222/135 |
| 2008/0257911 | A1 * | 10/2008 | Choi et al. | 222/320 |
| 2009/0008413 | A1 * | 1/2009 | Choi et al. | 222/256 |
| 2011/0114674 | A1 * | 5/2011 | Nicolle et al. | 222/321.9 |
| 2012/0000943 | A1 * | 1/2012 | Pares Montaner et al. | 222/321.2 |

FOREIGN PATENT DOCUMENTS

| | | |
|---|---|---|
| JP | A-2001-171764 | 6/2001 |
| JP | A-2004-000834 | 1/2004 |
| JP | A-2005-103424 | 4/2005 |
| JP | A-2007-229604 | 9/2007 |
| JP | A-2008-006410 | 1/2008 |

OTHER PUBLICATIONS

Korean Office Action issued in Korean Application No. 10-2011-7002942 dated Sep. 27, 2012 (w/translation).

Australian Office Action issued in Australian Application No. 2009310932 dated Jul. 18, 2012.

Dec. 14, 2012 Office Action issued in Canadian Application No. 2,734,114.

Mar. 26, 2013 Office Action issued in Chinese Patent Application No. 200980141164.3 (with translation).

* cited by examiner

DEPRESSION HEAD FOR PUMP AND DEPRESSION HEAD TYPE DISCHARGE PUMP

TECHNICAL FIELD

The present invention relates to a depression head for a pump and a depression head type discharge pump, particularly suitable for discharging liquid and cream.

RELATED ART

Known is a depression head for a pump comprising a bed member having a sliding cylinder extending upwardly from a bed plate and communicating with a stem of a pump, a head body having a liquid conduit fitted into the sliding cylinder in a liquid-tight manner and extending downwardly from a lower face of a transversely mounted cylinder provided with a nozzle opened at its leading end, a valve rod member for insertion into the cylinder and being forwardly biased, and a lever member having one end coupled to a rear end portion of the valve rod member, the other end contacting the bed plate, and an intermediate portion pivotably supported by the head body. When the head body is pressed down toward the bed member, the valve rod member is pulled backwardly due to rotation of the lever member to open a nozzle valve formed between the valve rod member and a valve seat of the nozzle. When the depression is released, the nozzle is configured to be closed (see, Patent Documents 1 and 2). In addition, known is a various configuration for displacing the valve rod member backwardly and forwardly (see, Patent Document 3).

Patent Document 1: JP 2004000834 A
Patent Document 2: JP 2007229604 A
Patent Document 3: JP 2005103424 A

DISCLOSURE OF THE INVENTION

In the depression head type discharge pump described in Patent Documents 1 and 2, it is likely that the atmospheric air flows back from the nozzle valve to inside of the discharge pump after the cylindrical piston is depressed via the depression head to the lower limit position. The reason of this is as follows: once the cylindrical piston reaches the lower limit position, the lever member is rotated by a forward bias force of the valve rod member, the head body is elevated with respect to the bed member to shut the nozzle; in this valve-shutting process, several members moves respectively and each movement involve friction resistance, so that there is a small time difference from the time that the cylindrical piston start moving upwardly from the lower limit position to the time that the nozzle is shut. In this time difference, the sliding cylinder of the depression head is displaced upwardly with respect to the stem of the discharge pump, so that a negative pressure occurs inside of the stem to draw the atmospheric air.

The air withdrawn inside of the cylinder contacts with a content in the cylinder, so that the content is likely to be dried and solidified. The accumulation of the solidified substance in the cylinder encumbers a smooth discharge of the content. In addition, depending on the nature of the content, the quality of the content may be deteriorated.

The first object of the present invention is to provide a depression head and a depression head type discharge pump with a nozzle being open and shut by forward and backward displacements of the valve rod member, wherein a bias means is interposed between base and tip portions of the valve rod member to prevent the air from flowing back.

The second object of the present invention is to provide a depression head and a depression head type discharge pump in which the base portion and the tip portion of the valve rod member are formed separately, and an engagement of the base and tip portions can certainly shut the nozzle.

The third object of the present invention is to propose a depression head and a depression head type discharge pump in which the base portion and the tip portion of the valve rod member are formed separately, and the base portion is displaceably engaged with the tip portion upon assembly operation to facilitate the operation.

The first embodiment of the present invention is a depression head for a pump comprising a head body 24 having a liquid conduit 36 communicating with a stem 6 of a discharge pump and hanging from a lower face of a transverse cylinder portion 30 provided with a nozzle 34 opened at its leading edge portion, a valve rod member 52 for insertion into the cylinder portion 30, and a first bias means 62 for forwardly biasing the valve rod member, the depression head being constructed so that a nozzle valve 56 is formed by a valve seat provided on the nozzle 34 and a tip portion of the valve rod member 52, the valve rod 52 is displaced backwardly when the head body 24 is depressed, and the valve rod member 52 is displaced forwardly by the forward bias force of the first bias member 62, wherein the valve rod member 52 is formed by a base portion 58 forwardly biased by the first bias means 62 and a tip portion 66 forwardly and displaceably projecting from the base portion 58, and a second bias means 70 forwardly biasing the tip portion 66 against the base portion 58 toward the valve seat 35 side is provided so as to, in a condition where the base portion 58 is in a receded position, be able to release the tip portion 66 from the valve seat 35 against the bias force of the second bias means 70 when the internal pressure of the cylinder portion 30 is increased, and to shut the valve seat 35 when the internal pressure of the cylinder portion 30 is decreased.

This embodiment proposes a depression head for a discharge pump involving a function of preventing an air inflow in which the valve rod member 52 is displaced forwardly and backwardly to shut and open a nozzle hole. As mentioned above, the reason of the air inflow is that it takes quite a while from the time where the stem 6 of the discharge pump is turned to upwardly move from the lowermost position till the head body 24 and the valve rod member 52 returns to the original position. The gist of this embodiment is, therefore, that the tip portion 66 of the valve rod member 52 directly sealing the valve seat 35 is separated from the rest of the constituting portions which move slowly so as the tip to be able to quickly move forward to shut the valve seat.

The "head body 24" of the present invention has a conventionally known configuration, and its function is explained, in brief, as an upwardly and downwardly movable operating portion. The head body 24 also houses the cylinder portion 30 and the cylinder portion 30 may have a generally cylindrical shape with a function of holding the valve rod member 52 in a forwardly and backwardly slidable manner.

The "valve rod member 52" is displaced forwardly and backwardly in the cylinder portion 30 and opens and closes the nozzle valve 56 to avoid a drip from the nozzle hole. The valve rod member 52 is divided into the base portion 58 and the tip portion 66. The base portion 58 and the tip portion 66 at least have a configuration that the tip portion 66 moves forwardly with respect to the base potion 58 to seal the nozzle, but it is desired that they are formed as separated bodies as shown in the figures of the preferred examples.

The "base portion 58" is a longitudinal member extending through a back section of the cylinder portion 30 and is forwardly biased against the back section by the first bias means 62. This makes it possible for the base portion 58 to move backwardly against the forward bias force.

The "tip portion 66" have a function of hermetically sealing the valve seat of the nozzle in the same manner as a leading half of a valve rod member 52 having a conventional single-piece configuration when the base portion 58 is in the forwardmost position. The tip portion is configured so as to, after the base portion 58 is displaced toward the backmost position, release from the valve seat 35 and move backwardly when the pressure in the cylinder portion 30 is high, and to move forwardly to sit on the valve seat 35 when the internal pressure is low. In order to enable these movements, the tip portion 66 has a shape capable of receiving the pressure in the cylinder portion 30 at its front face side and of moving backwardly. This will be explained later.

The second embodiment includes the first embodiment, and wherein the forward bias force of the second bias means 70 is smaller than the forward bias force of the first bias means 62.

The "first bias means 62" and the "second bias means 70" can be formed as an elastic means such as a coil spring and an elastic ring which is commonly used for closing a valve. In this means, the first bias member 62 is designed so as to, in a state where the first bias means 62 is mounted in the cylinder portion 30, exert an elasticity E1 sufficient to push the head body 24, which is lowered as described above, via the valve rod member 52. The second bias means 70 is designed so as to, in a state where the second bias means 70 is interposed between the base portion 58 and the tip portion 66, have the elasticity E2 expressed as the following equation (1). This is because a part of operating portions (the tip portion of the valve rod member) can be advanced by a force smaller than that necessary for pushing up the operating section of the depression head.

$$E1>E2 \quad (1)$$

On the other hand, the second bias means 70 is designed so as to, in a state where the tip of the valve rod member 52 is displaced backwardly as shown in FIG. 5, exert an elastic force larger than at least a static friction resistance D1 between the tip portion and the inner wall of the cylinder portion 30. This is because unless this condition is not satisfied, the tip portion 66 cannot be displaced from the backmost position toward the valve seat 35 side. Further, when the content liquid is a viscous liquid, the friction resistance (liquid friction) D2 has to be taken into consideration. Suppose F2 represents the elastic force when the tip portion 66 is at the backmost position as shown in FIG. 5, the following relationship (2) is satisfied. This will be further discussed later. It is desired to design the bias means to have an elastic force capable of applying the present invention to a liquid having a coefficient of viscosity of about 30-70,000 cP (0.03-70 Pa·s).

$$F2>D1+D2 \quad (2)$$

Furthermore, the second bias means 70 is formed with an expandable/retractable elastic body such as a coil spring, and the natural length of the elastic body is set to be longer than the distance between the attaching positions of the elastic body at the base portion 58 side and the tip portion 66 side when the base portion 58 is at the backmost position. This makes it possible for the tip portion to advance ahead from the state where the base portion is receded to close the valve seat.

The third embodiment includes the second embodiment, and further comprises a bed member 12 having a sliding cylinder 20 extending upwardly from a bed plate 16 and fitted into the liquid conduit 36 in a liquid-tight manner, and a lever member 46 having one end coupled to a rear end portion opposite to the tip portion side of the base portion 58 of the valve rod member 52, the other end contacting the bed plate 16, and an intermediate portion pivotably supported by the head body 24, wherein the bed member 12 and the lever member 46 is arranged so that when the head body 24 is pressed down toward the bed member 12, the base portion 58 of the valve rod member 52 can be displaced backwardly by the rotation of the lever member 46.

According to this proposal, it is proposed that the advancing and receding displacements of the valve rod member 52 linked with the lever member 46 are actively aided by a rotation of the lever member 46 rotatably fitted to the head body 24, so that smooth open and close operations of the nozzle valve 56 can be facilitated. The "bed member 12" and the "lever member 46" have conventionally known configurations, are arranged in the head body 24 and possess a function as a pedestal elevetably guiding the head body 24, and engages with one end of the lever member 46, and a function of transferring a vertical movement into a transverse movement of the valve rod means 52. In this case, the first bias means 62 is designed so as to elevate the head body 24 having been lowered via the valve rod member 52 and the lever member 46 i.e., an operation portion with respect to the bed member, and to exert elasticity E1 sufficient for rotating the lever member 46.

The fourth embodiment includes the first, second and third embodiments, and is configured so that the base portion 58 and the tip portion 66 are formed as separate parts arranged on a horizontal line in the transversal direction, a first engagement portion 64 and a second engagement portion 72 which separate from each other in a condition where the base potion 58 is receded and which contact with each other in a condition where the base portion 58 is advanced are formed at corresponding positions of the base portion 58 and the tip portion 66, and the tip portion 66 can be press-contacted against the rear face of the valve seat 35 in a liquid-tight manner via the first and second engagement portions 64, 72 by the forward bias force of the first bias means 62 when the base portion is at the forwardmost position.

In this embodiment, the front portion of the base portion 58 is engaged with the tip portion of the valve rod member 52 in a condition where the depression head 10 is not depressed, thereby transmitting the forward bias force of the first bias means 62 to the tip portion 66 contacting the rear face of the nozzle. That is, it is proposed that the base portion 58 and the tip portion 66 are engaged with each other when the valve is shut to be able to maintain the valve-shutting condition. In particular, as shown in FIG. 1, the head may be configured so as the front face of the first engagement portion 64 at the base portion side and the rear face of the second engagement portion 72 at the tip portion side to be contacted with each other when the nozzle 56 is shut.

The fifth embodiment includes the forth embodiment, wherein the tip portion 66 is a cylindrical body with its tip being closed and a part of the cylindrical body in the axial direction being a large external diameter portion 54; an outer face of the large external diameter portion 54 serves as a seal face sliding in the cylinder portion 30 in a liquid-tight manner; at least the front face of the large external diameter portion 54 serves as a pressure-receiving face 74 for receiving the pressure in the cylinder portion 30 to allow the tip portion 66 to recede; the base portion 58 is a rod body extending in the transversal direction; and the front half of the rod body is inserted in a cylinder hole 68 of the tip portion 66 to interpose a second bias means 70 between the front portion of the cylinder hole 68 and the front half of the base portion 58.

This embodiment proposes that the tip portion is formed in a cylindrical body with front end face of its tip portion being closed; the front half of the base portion, which is the rod body, can be inserted in the cylinder hole; and the second bias means 70 such as a coil spring is interposed between the front portion (inner portion) and the front half of the base portion. This allows the cylindrical tip portion 66 to be stably advanced and receded on the cylinder axis with respect to the rod-like base portion 58. In addition, a part of the cylinder wall of the tip portion 66 is formed as a large external diameter potion 54 to allow the outer face of the large external diameter potion 54 to serve as a seal face slidable on the inner face of the cylinder portion 30. In this way, the stroke of the tip portion 66 with respect to the cylinder portion 30 can be stabilized and a contact between the second bias means 70 and the content (liquid article) can be avoided, which is particularly advantageous when the bias means is made of a metal. Furthermore, the formation of the large external radius portion 54 can enlarge the pressure receiving face contacting the content (liquid article) in the cylinder portion 30.

The sixth embodiment includes the fifth embodiment, wherein a locking portion 78 is formed in the front half of the base portion 58 and a locked portion 82 is formed in the cylinder hole 68 of the tip portion 66, thereby locking the locking portion 78 with the locked portion 82 to integrally link the base portion 58 and the tip portion 66; and a displacement margin is provided between the front end of the base portion 58 and the inner portion of the cylinder hole 68.

This embodiment proposes a provision of the locking portion and the locked portion for temporally joint the base portion 58 and the tip portion 66 which are formed as separate bodies. In this way, the valve rod member 52 can be a single unit, which is advantageous for storing the valve rod member 52 as a part and for assembling.

The seventh embodiment is a depression head type discharge pump, wherein a stem 6 extends upwardly from a cylindrical piston 4 sliding in a pump cylinder 2; a depression head 10 according to any one of first to six embodiments is mounted on the upper end of the stem 6; and the forward bias force of the second bias means 70 is set so that the tip portion 66 of the valve rod member 52 releases from the valve seat 35 in response to the pressure in the pump cylinder 2 caused when the cylindrical piston 4 is depressed while the tip portion of the valve rod member 52 seals the valve seat 35 when the cylindrical piston 4 returns upwardly from the lowermost position.

This embodiment proposes a depression head type discharge pump to which the afore-mentioned embodiments are applied. The condition that the tip portion 66 of the valve rod member seals the valve seat 35 is as follows: in a series of operation of a depression head, for example, comprising a bed member 12 as shown in FIG. 1, a distance Δh (sliding margin) of elevating the head body 24 with respect to the bed member is set, and an absolute value of a negative pressure generated in the cylinder portion 30 due to an elevation of the head portion 24 in a condition where a discharge valve and the nozzle valves 56 are closed is represented as ΔP. The modulus of elasticity may be set so that the resilient force of the second bias means 70 is larger than ΔP.

The inventions according to the first and seventh means provide a depression head and depression head type discharge pump, respectively, in which the valve rod member 52 is divided into the base portion 58 and the tip portion 66, and the first bias means 62 for forwardly biasing the base portion 58 against the head body 24 and the second bias means 70 for forwardly biasing the tip portion 66 against the base portion 58 are respectively provided, so that the tip portion 66 can seal the nozzle 34 in a condition where the base portion 58 has been displaced backwardly to prevent a reverse flow of air.

According to the invention of the second embodiment, the seal of the nozzle by the tip portion can be achieved more steadily.

According to the invention of the third embodiment, the rotation of the lever member 46 rotatably fitted to the head body 24 actively aids the advancing and receding displacement of the valve rod member 52 linked with the lever member 46 to smoothly open and shut the nozzle valve 56.

According to the invention of the forth embodiment, the tip portion 66 contacts the rear face of the valve seat 35 via the first engagement portion 64 and the second engagement portion 72 due to the bias force from the first bias means 62, so that liquid leakage can be securely prevented.

According to the invention of the fifth embodiment, the tip portion 66 is a cylindrical body separately formed from the base portion and a part of the cylindrical body of the tip portion in the axial direction is fitted in the cylinder portion 30 in a liquid-tight manner, so that the content (liquid article) is prevented from contacting the second bias means 70 especially when the second bias means 70 is made of a metal, which is effective for suppressing degradation of the content and deterioration of the bias means.

According to the invention of the sixth embodiment, the base portion 58 and the tip portion 66 are integrated by providing the locking portion 78 and the locked portion 82, respectively, thereby facilitating the assembly.

BEST MODE FOR CARRYING OUT THE INVENTION

Figure 1:
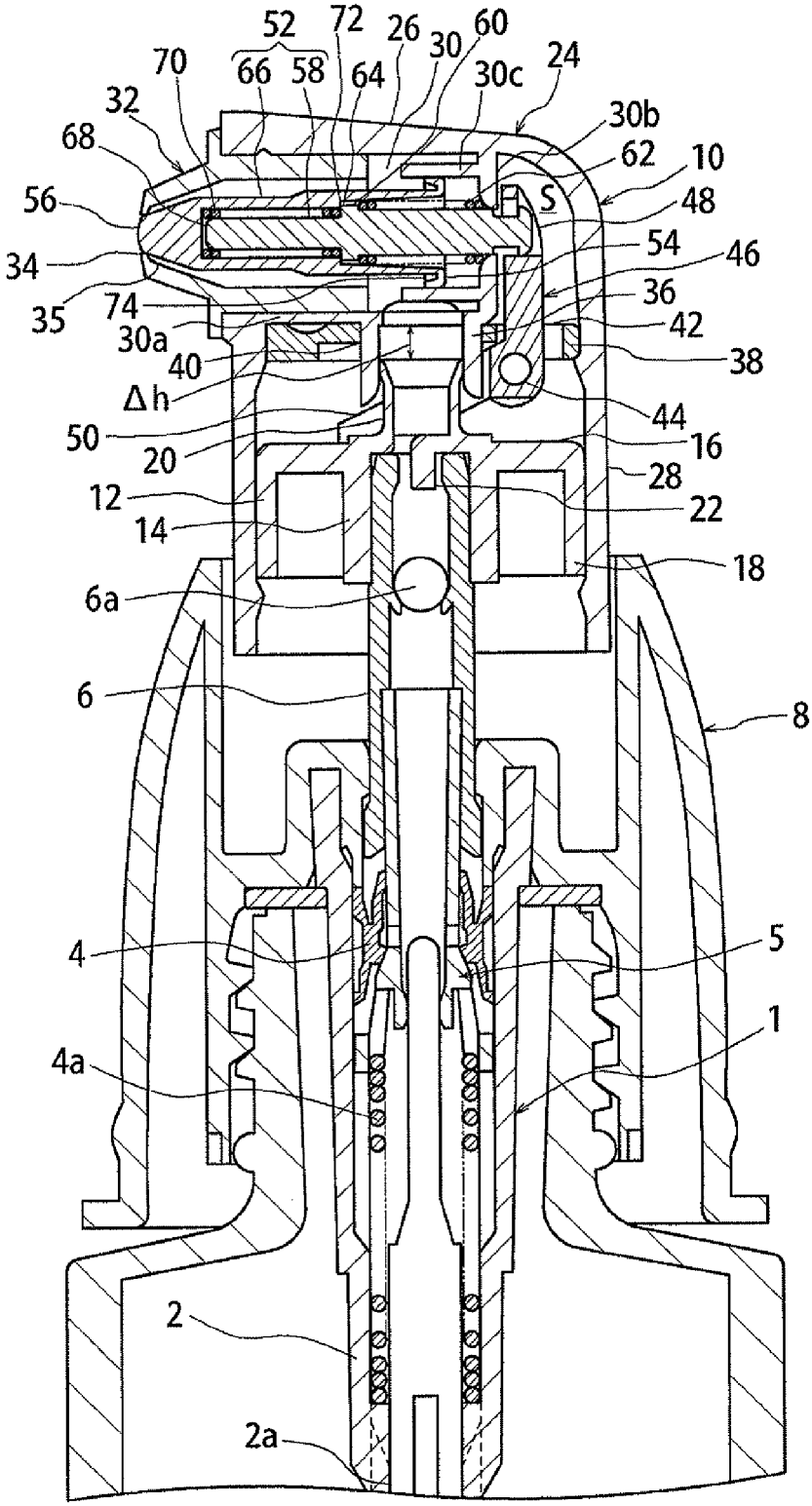
FIG. 1 is a longitudinal sectional view of a depression head type discharge pump according to the first example of the present invention.

FIGS. 1 through 7 show a depression head type discharge pump and a depression head according to the first example of the present invention. For the convenience of explanation, the configurations of this depression head type discharge pump is divided into basic configurations as premises of the present invention and characteristic configurations deeply associated with the essence of the invention, and the former is firstly discussed.

A body 1 of the depression head type discharge pump has a pump cylinder 2 provided with a suction valve 2*a* at the lower end portion, a cylindrical piston 4 sliding in the pump cylinder, a piston guide 5 on which the cylindrical piston is mounted in a vertically movable manner, and a stem 6 with a discharge valve 6*a* fitted onto the upper part of the piston guide. A depression head 10 is attached to the upper end portion of the stem 6. A coil spring as an upwardly bias means 4*a* for biasing the stem 6 upwardly via the piston guide is interposed between the piston guide and the lower portion of the pump cylinder 2. The reference numeral 8 designates a mounting member for fixing the pump cylinder 2 on a neck portion of a container body.

The depression head 10 is composed of a bed member 12, a head body 24, a support board 38, a lever member 46 and a valve rod member 52. Each of these elements may be made of a synthetic resin.

The bed member 12 has an engagement cylinder 14 engaged with an upper end portion of the stem 6, a flange-line bed plate 16 extending outwardly from an upper end of the engagement cylinder 14, a guide peripheral wall 18 hanging from the bed plate, and a sliding cylinder 20 extending upwardly from an inner peripheral portion of the bed plate 16. In the example shown in the figure, a projection 22 hanging via a plurality of connecting pieces from an inner edge of the bed plate 16 into the stem 6.

The head body 24 has an outer peripheral wall 28 hanging from the peripheral edge of a top plate 26, and an opening provided at a front portion of the outer peripheral wall 28. A cylinder portion 30 consists of a cylinder wall 30*a* forming a cylinder body arranged in the head body and extending from the cylinder portion 30, the cylinder body being provided with the opening at a front end face thereof and containing a part of the top plate 26, a rear wall 30*b* closing the rear face of the cylinder wall 30*a*, and a guide cylinder 30*c* projecting forwardly from the front face of the rear wall 30*b*. A space (displacement margin) S is provided between the rear wall 30*b* and the rear portion of the outer peripheral wall 28 of the head body 24. In this example, an auxiliary cylinder 32 is fitted into the front half of the cylinder portion 30 with the front end portion thereof being projected from the head body 24. The front end portion of the auxiliary cylinder 32 is a nozzle 34 with its tip end being tapered to have a smaller diameter. A hole edge of a nozzle hole of the nozzle 34 is formed to have a slightly smaller diameter to allow the rear portion of the hole edge to be a valve seat 35 for the valve rod member 52. Further, a communication hole is provided at the lower side of a rear half of the cylinder wall 30*a* of the cylinder portion 30, and a liquid conduit 36 hanging from the communication hole. The liquid conduit 36 and the outer peripheral wall 28 are slidably fitted with the outer face of the sliding cylinder 20 of the bed member 12 and the outer face of the guide peripheral wall 18 of the outer peripheral wall 28, respectively.

The support board 38 is provided with a support hole 40 and a through hole 42 at the central portion and the rear portion, respectively, and bearing portions 44 are formed on both sides of the through hole. Also, the support hole 40 and the outer edge portion of the support board 38 are fitted on the outer face of the liquid conduit 36 and the inner face of the outer peripheral wall 28 of the head body 24, respectively.

The lever member 46 is pivotably supported by the bearing portions 44 at the intermediate portion from which a first arm 48 for linking with the valve rod member 52 extends upwardly into the space and a two-pronged second arm 50 projects obliquely forward and downward. As shown in FIG. 1, the lever member 46 is formed in a dogleg shape as viewed from the side. The second arm 50 slidably contacts the upper face of the pedestal portion with the liquid conduit 36 and the sliding cylinder 20 being sandwiched therebetween.

The base portion 58 of the valve rod member 52 extends from inside of the cylinder portion 30 through the rear wall 30*b* of the cylinder portion 30 and projects into the space S to link with the leading edge portion of the first arm 48 of the lever member 46. The tip portion 66 of the valve rod member 52 has a large external diameter portion 54 at the rear half, and the large external diameter portion 54 is slidably engaged with the inner face of the guide cylinder 30*c* of the cylinder portion 30 in a liquid-tight manner. The front edge portion of the valve rod member 52 (tip portion 66) contacts the valve seat 35 at the rear face side of the nozzle 34 at, thereby forming a nozzle valve 56.

In the present invention, the valve rod member 52 consists of the base portion 58 and the tip portion 66 which can move back and forth independently. It is noted that the term "base portion" as used herein means a movable portion situated close to the base edge, and the term "tip portion" means another movable portion situated close to the tip edge. In this example, the base portion 58 is formed into a rod body and the tip portion 66 is formed into a cylindrical body. The read edge portion of the base portion 58 passes through the rear wall 30*b* of the cylinder portion 30 and the upper edge portion of the first arm 48 of the lever member 46 and is locked with the rear face of the upper edge portion of the first arm 48. An intermediate thick portion 60 is formed at a longitudinally intermediate position of the base portion 58, and a first coil spring as a first bias means 62 is interposed between a stepped face at the rear side of the intermediate thick portion 60 and the front face of the rear wall 30*b* of the cylinder portion 30. A second coil spring as a second bias means 70 is interposed between an inner peripheral portion of a stepped face at the front side of the intermediate thick portion 60 and an inner portion (front face) of a cylinder hole 68 of the cylindrical tip portion 66. An outer peripheral portion of the stepped portion at the front side of the intermediate thick portion 60 is a first engagement portion 64 for engaging with the tip portion 66.

The tip portion have a cylinder hole 68 elongated in the lateral direction, and the rear half of the cylinder hole 68 is a large internal diameter portion expanding via a step portion. The stepped face is a second engagement portion capable of engaging with the first engagement potion 64. The tip portion 66 is turned back forward and outward from the rear edge of the cylinder body, and the turned-back portion forms the large external diameter portion 54. A space to which the second coil spring as the second bias means 70 can be inserted is provided between the inner peripheral face of the front half of the cylinder hole 68 and the outer peripheral face of the front half of the base portion 58. A portion of the surface of the tip portion 66 receiving the liquid pressure in the cylinder backwardly forms a pressure receiving face 74. In the example shown in the figure, almost all of the pressure receiving face is occupied by the front face of the large external diameter portion 54. It is configured that when the backside component of the liquid pressure acts on the pressure receiving face 74, the tip portion 66 is displaced backwardly.

Figure 3:
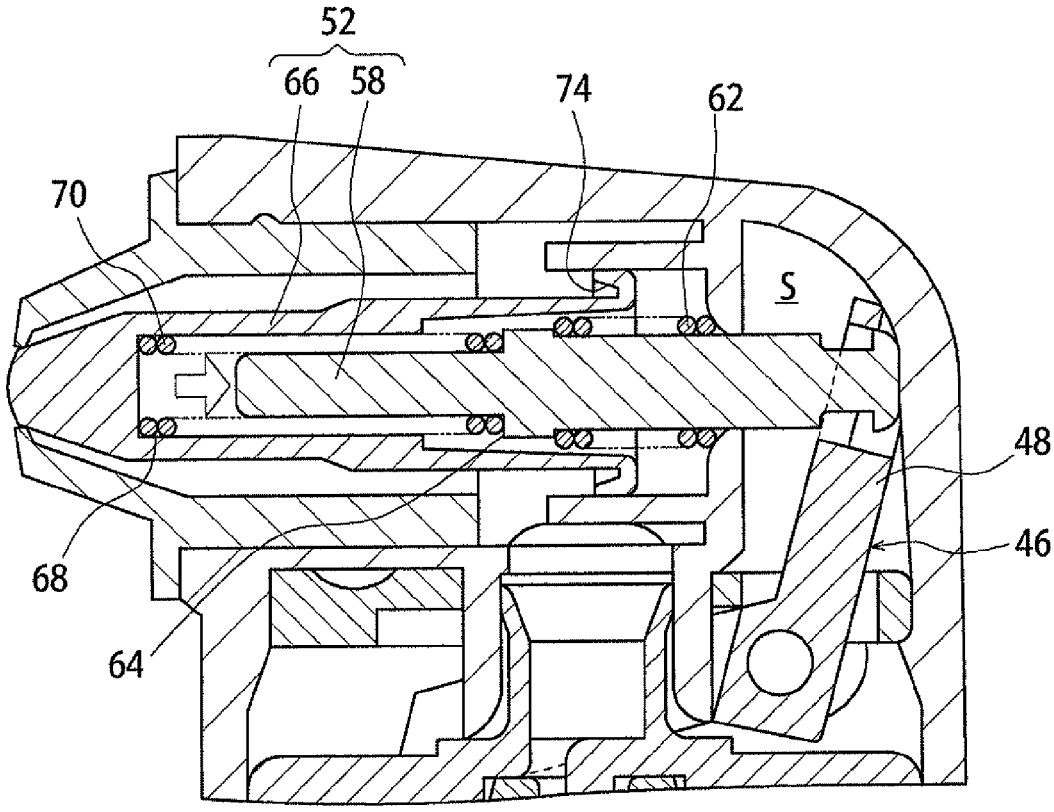
FIG. 3 is a longitudinal sectional view of a principal part in the stage shown in FIG. 2.
Figure 4:
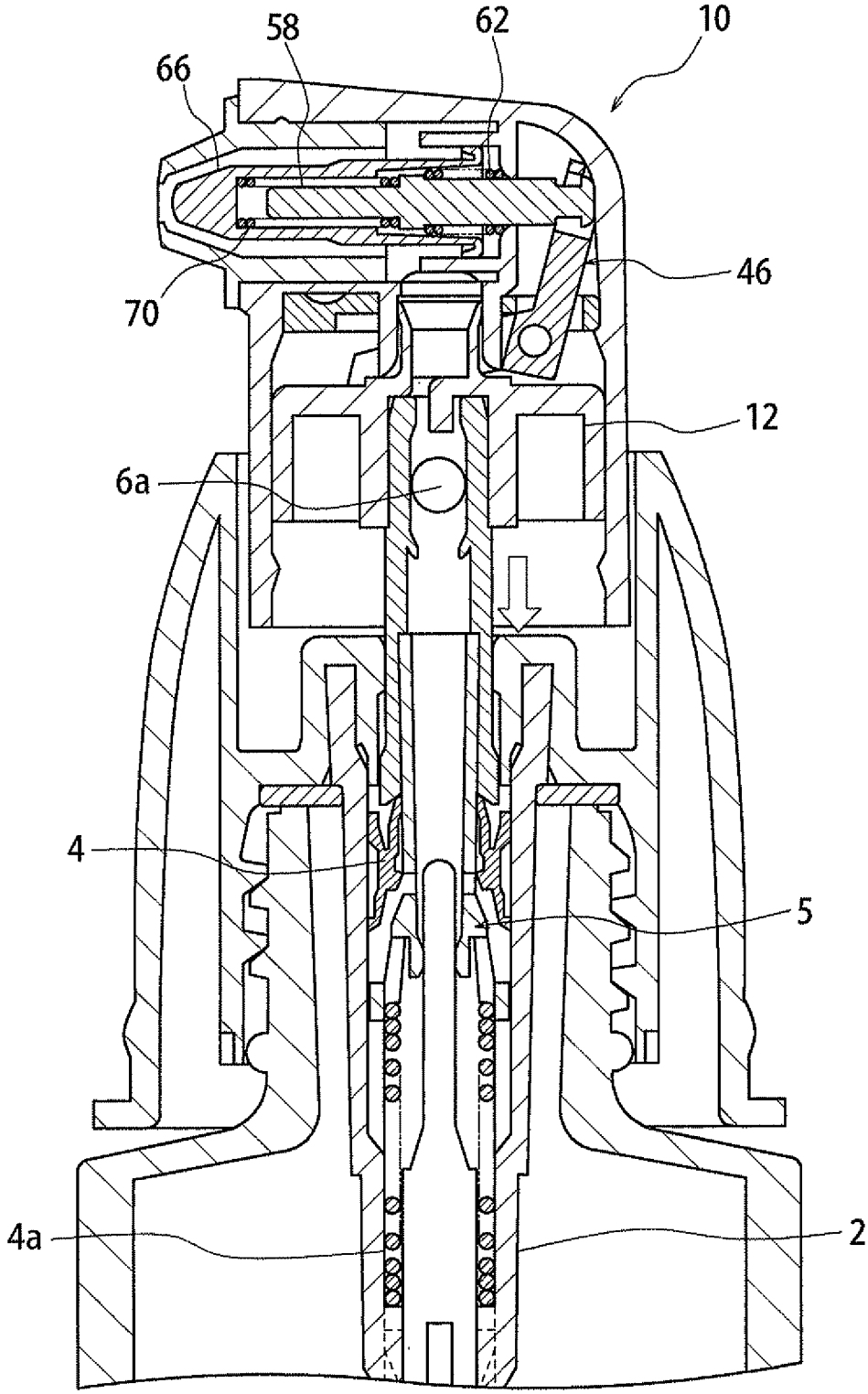
FIG. 4 is a longitudinal sectional view of the depression head type discharge pump shown in FIG. 1 in the second stage of its operation.
Figure 5:
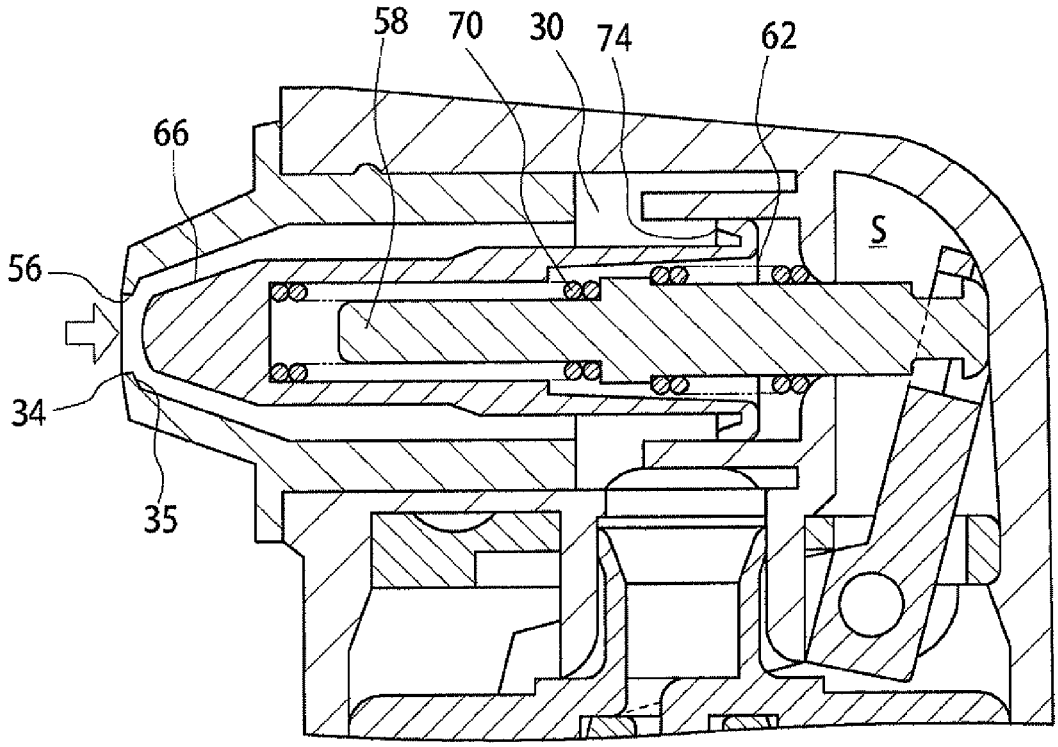
FIG. 5 is a longitudinal sectional view of a principal part in the stage shown in FIG. 4.
Figure 6:
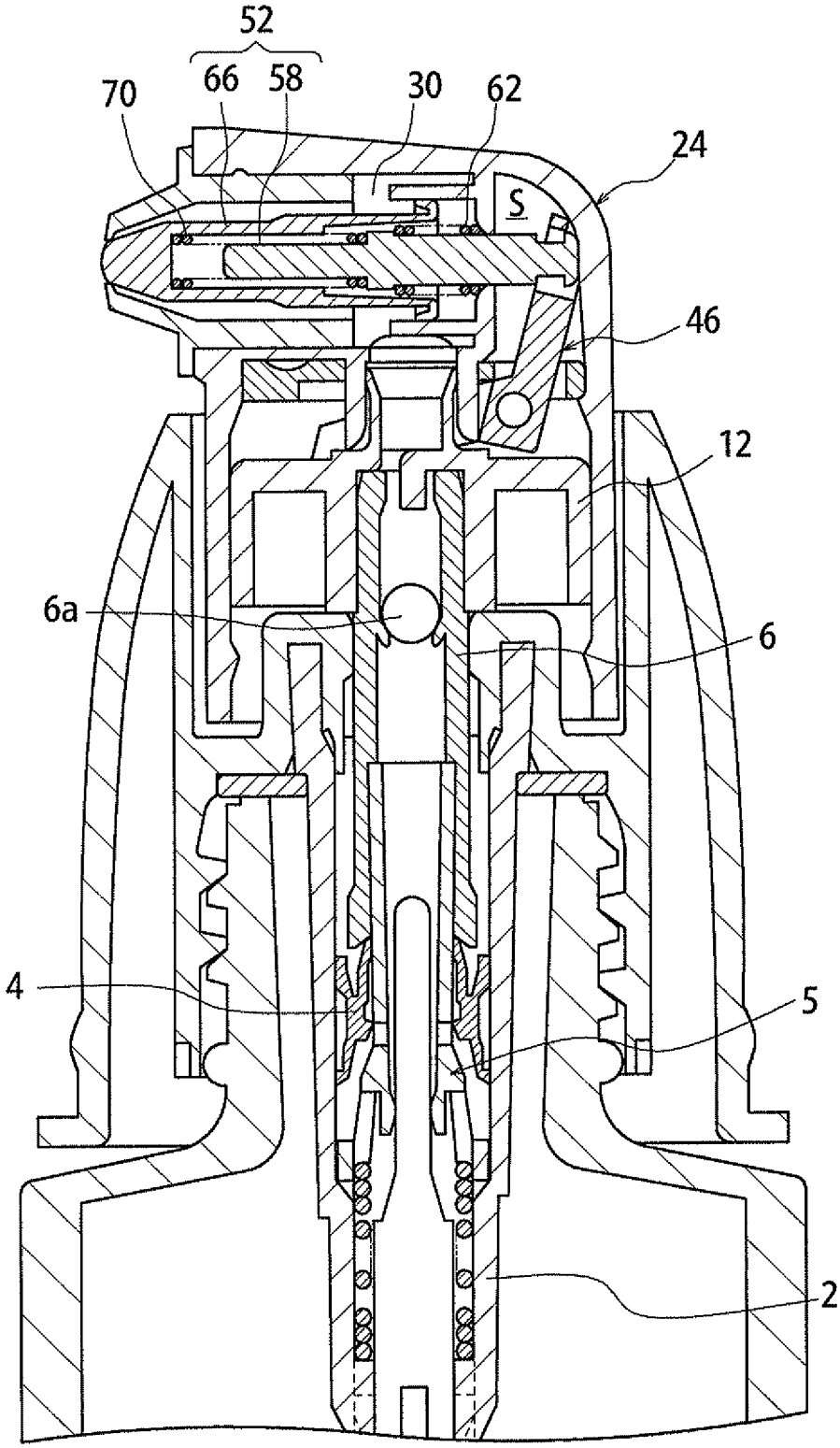
FIG. 6 is a longitudinal sectional view of the depression head type discharge pump shown in FIG. 1 in the third stage of its operation.
Figure 7:
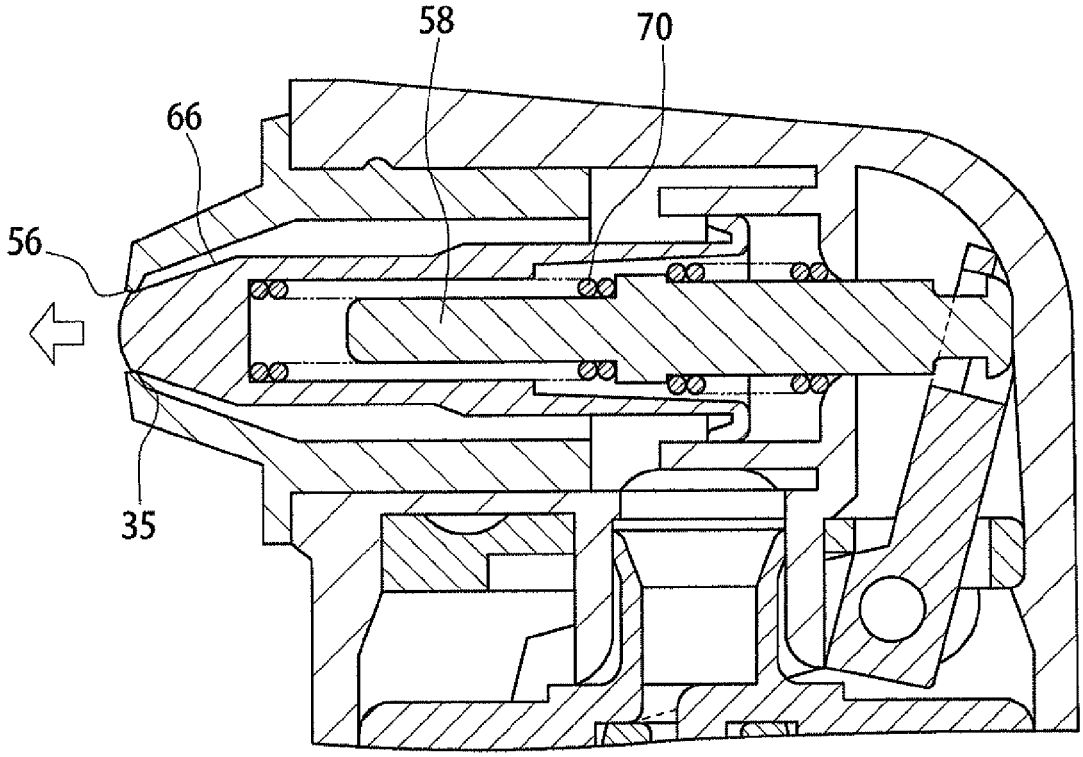
FIG. 7 is a longitudinal sectional view of a principal part in the stage shown in FIG. 6.

The second coil spring as the second bias means 70 uses a weak spring having a smaller modulus of elasticity than that of the first coil spring as the first bias means 62. It is noted that the second coil spring has a forward bias force capable of advance the tip portion 66 against the friction resistance between the tip portion 66 ant the cylinder wall 30*a* when the base portion 58 is receded and the cylindrical piston is elevated from the lowermost position. As widely known, the friction resistance between two objects is larger in the moving state than in the stationary state, so that it is sufficient that a condition that the tip portion 6 can move forwardly from the rear most position is satisfied. In order to achieve the condition, it is sufficient to satisfy the relationship of the equation 2 (F2>D1+D2). In this example, D1 denotes a friction resistance between the inner face of the guide cylinder 30*c* of the cylinder portion 30 and the outer face of the large external diameter portion 54, and D2 denotes a friction resistance between the surface of the tip portion 66 (mainly the large external diameter portion 54) and the inner face of the flow path generated during the displacement of the tip portion 66. The friction resistance D2 depends on the viscosity of the contents. The viscosity of ordinal shampoo for is about 5000 cp (5 Pa·s). The natural length of the second coil spring is set to be larger than the distance between the attaching position (first engagement portion) for the rear edge of the coil and the attaching position (front face of the cylinder hole) for the front edge of the coil in a state that the base portion 58 is displaced backwardly to the rearmost position as shown in FIG. 3.

Figure 2:
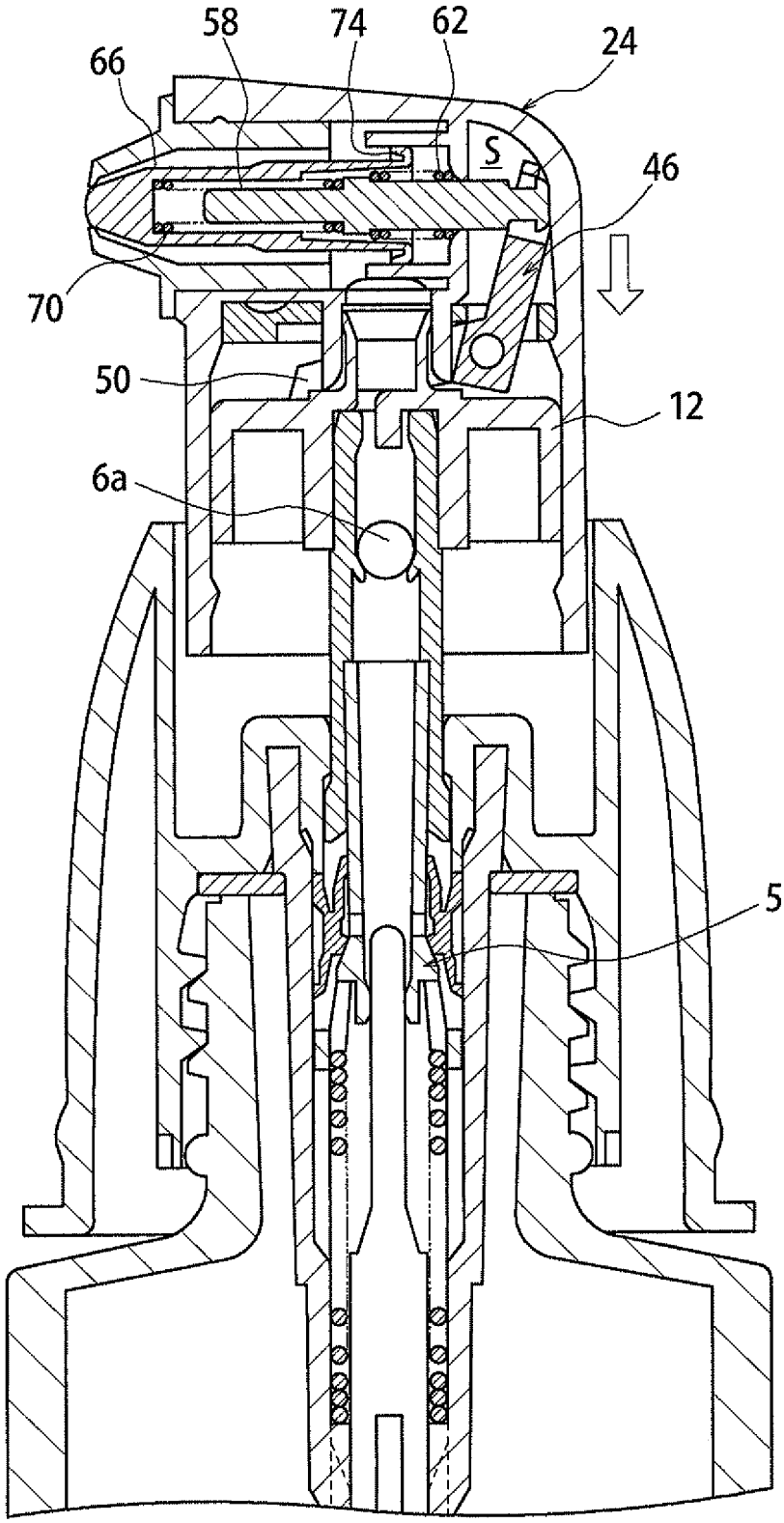
FIG. 2 is a longitudinal sectional view of the depression head type discharge pump shown in FIG. 1 in the first stage of its operation.

In this configuration, when the depression head 10 is depressed from the state as shown in FIG. 1, the head body 24 is descended with respect to the bed member 12 as shown in FIG. 2. The lower edge of the second arm 50 is engaged with the upper face of the bed member 2, so that the lever member 46 rotates about the axis and the first arm 48 is displaced backwardly as shown by the arrow in FIG. 3 to displace the base 58 of the valve rod member 52 backwardly against the elastic force of the first bias means 62. Along with the backward displacement of the base portion 58, the second bias means 70 is expanded form the compressed state. At this stage, the tip portion 66 is not yet released from the valve seat 35 as shown in FIG. 3. When the head body 24 is completely descended with respect to the bed member 12, then the stem 6 and the cylindrical piston 4 is descended along with the depression head 10 as shown by the arrow in FIG. 4, and the liquid in the pump cylinder 2 is pumped via the stem 6 to inside of the cylinder 30. This raises the liquid pressure in the cylinder portion 30 which acts upon the pressure receiving face 74 of the tip portion 66, so that the tip portion 66 is released from the valve seat 35 and displaced backwardly against the elastic force of the second bias means 70 as shown by the arrow in FIG. 5. As a result, the nozzle valve 56 is opened and the liquid in the cylinder 30 is ejected. When the cylindrical piston 4 is lowered to the lowermost position (see FIG. 6), the liquid pressure in the room from the pump cylinder 2 to the cylinder portion 30 returns to the normal pressure. Thus, the tip portion 66 of the valve rod member 52 is displaced forwardly with respect to the base portion 58 due to the resilient force as shown by the arrow in FIG. 7 to shut the valve seat 35.

On the other hand, when the cylindrical piston 4 reaches the lowermost position and then the force for depressing the depression head 10 is released, the stem 6 is elevated to shut the discharge valve 6*a* and the base portion 58 of the valve rod member 52 is advanced toward its initial position due to the elastic force of the first bias means 62. Simultaneously, the head body 24 begins to be lifted with respect to the bed member 12 by the revolution of the lever member 46. As a result, the flow path from the discharge valve 6*a* to the nozzle 34 gets longer, which in turn causes a negative pressure in the flow path. In the conventional technique, atmospheric air flows into the flow path through the nozzle due to the negative pressure. Contrarily in the present invention, the valve seat 35 is preliminarily sealed by the tip portion 66 of the valve rod member 52, so that air cannot flow through the nozzle. In addition, the biasing force of the second biasing means 70 is set so that the contact (sealed) state between the tip portion 66 and the valve seat 35 can be maintained even under the negative pressure.

It is noted that although, in this example, the advancing and receding movements of the valve rod member 52 linking with the lever member 46 are actively aided by the rotation of the lever member 46 rotatably fitted to the head body 24, the lever member 46 may be omitted and the valve rod member 15 may be passively advanced/receded only by the increase/decrease of the internal pressure of the cylinder portion 30. The mechanism for receding the base potion 58 of the valve rod member 52 may be such that can link with the valve rod member 52 in conjunction with the depression of the depression head 10 to backwardly displace the valve rod member 52, and various mechanism can be adopted.

Figure 8:
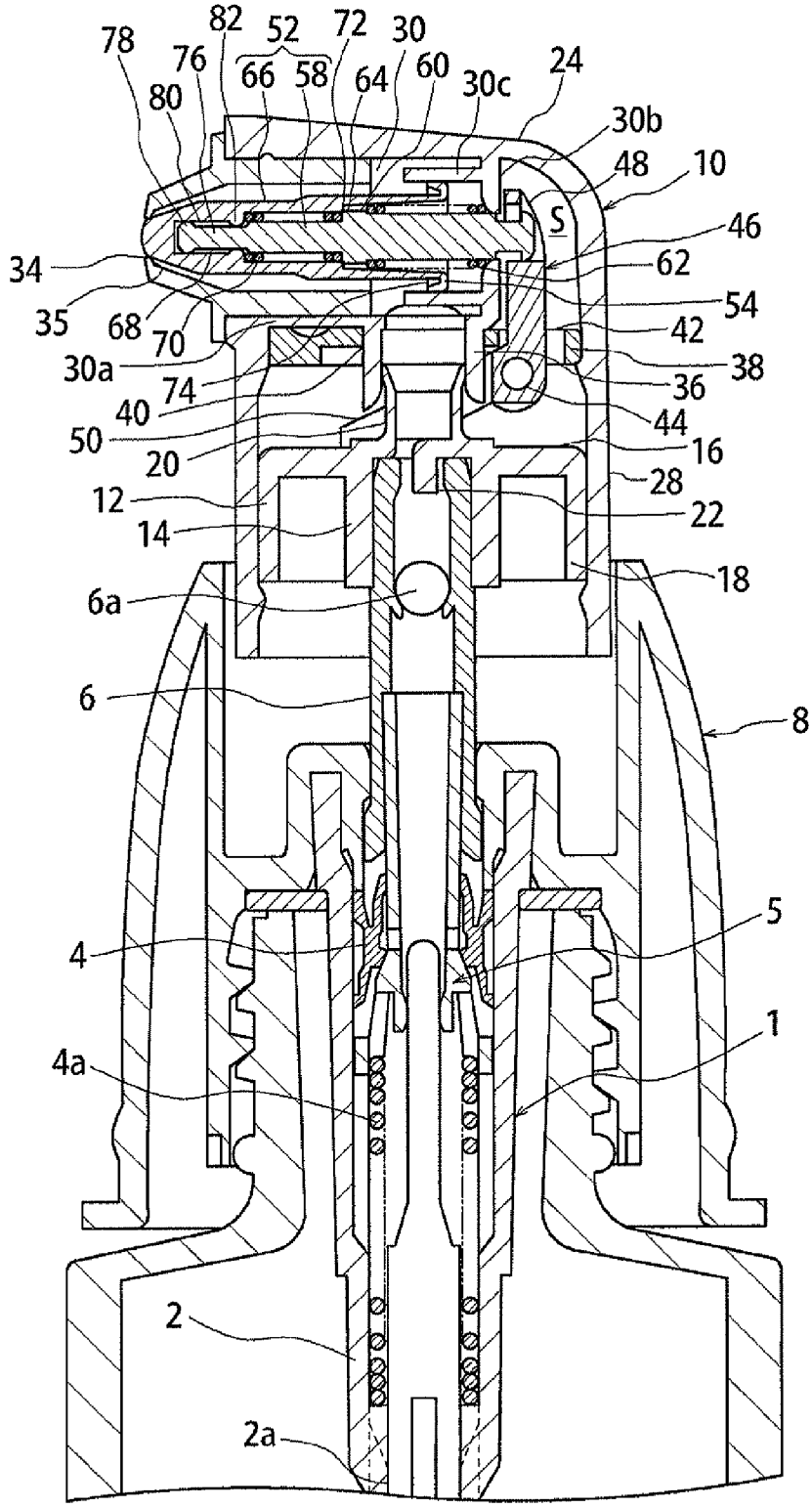
FIG. 8 is a longitudinal sectional view of a depression head type discharge pump according to the second example of the present invention.

FIG. 8 shows the second example of the present invention. In this example, the front portion of the base portion 58 of the valve rod member 58 is formed into a small diameter rod potion 76 and the front portion of the cylinder hole 68 is formed into a small diameter hole portion 80. A first rib as the engaging portion 78 and the second rib as the engaged portion 82 are circumferentially provided on the tip end of the outer face of the small diameter rod portion 76 and the inner edge of the small diameter hole portion 80, respectively, with the ribs being able to forcedly move over each other. In this way, the small diameter rod portion 76 of the base portion 58 can be linked with the tip portion 66.

REFERENCE SYMBOLS

1 discharge pump body
2 pump cylinder
2*a* suction valve
4 cylindrical piston
4*a* means for upwardly biasing the cylindrical piston
5 piston guide
6 stem
6*a* discharge valve
8 mounting member
10 depression head
12 bed member
14 engagement cylinder
16 bed plate
20 sliding cylinder
22 projection
24 head body
26 top plate
28 outer peripheral wall
30 cylinder portion
30*a* cylinder wall
30*b* rear wall
30*c* guide cylinder
32 auxiliary cylinder
34 nozzle
35 valve seat
36 liquid conduit
38 support board
40 support hole
42 through hole
44 bearing portion
46 lever member
48 first arm
50 second arm
52 valve rod member
54 large external diameter portion
56 nozzle valve
58 base portion

60 intermediate thin portion
62 first bias means
64 first engagement portion
66 tip portion
68 cylinder hole
70 second bias means
72 second engagement portion
74 pressure-receiving face
76 small diameter rod portion
78 engaging portion
80 small diameter hole portion
82 engaged portion

The invention claimed is:

1. A depression head for a pump comprising:

a head body having a liquid conduit communicating with a stem of a discharge pump and hanging from a lower face of a transverse cylinder portion provided with a nozzle with an opening at a leading edge portion of the nozzle;

a valve rod member for insertion into the cylinder portion; and a first bias means for forwardly biasing the valve rod member, the depression head being constructed so that a nozzle valve is formed by a valve seat provided on the nozzle and a tip portion of the valve rod member, the valve rod is displaced backwardly when the head body is depressed, and the valve rod member is displaced forwardly by a forward bias force of the first bias means, wherein the valve rod member is formed by a base portion forwardly biased by the first bias means and a tip portion forwardly and displaceably projecting from the base portion, the base portion and the tip portion are formed as separate parts arranged on a horizontal line in the transversal direction, a second bias means forwardly biasing the tip portion against the base portion toward the valve seat side is interposed between the base portion and the tip portion so as to, in a condition where the base portion is in a receded position, be able to release the tip portion from the valve seat against the bias force of the second bias means when an internal pressure of the cylinder portion is increased, and to shut the valve seat when the internal pressure of the cylinder portion is decreased, the tip portion is a cylindrical body with a closed tip and a part of the cylindrical body in the axial direction being a large external diameter portion; an outer face of the large external diameter portion serves as a seal face sliding in the cylinder portion in a liquid-tight manner and avoiding contact between the second bias means and the content; at least a front face of the large external diameter portion serves as a pressure-receiving face for receiving the internal pressure of the cylinder portion to allow the tip portion to recede, the base portion and the tip portion are formed as separate parts arranged on a horizontal line in a transversal directions, the base portion has a first stepped portion where the outer diameter of the base portion expands, the tip portion has a second stepped portion where the inner diameter of the tip portion expands, the first and second stepped portions separate from each other in a condition where the base portion is receded and contact with each other in a condition where the base portion is advanced, the tip portion can be press-contacted against a rear face of the valve seat in a liquid-tight manner via the first and second stepped portions by the forwarding bias force of the first bias means when the base portion is at a forwardmost position, the tip portion is a cylindrical body with its tip being closed and a part of the cylindrical body in the axial direction being a large external diameter portion; an outer face of the large external diameter portion serves as a seal face sliding in the cylinder portion in a liquid-tight manner; at least the front face of the large external diameter portion serves as a pressure-receiving face for receiving the pressure in the cylinder portion to allow the tip portion to recede, and the base portion is a rod body extending in the transversal direction, and the front half of the rod body is inserted in a cylinder hole of the tip portion to interpose the second bias means between the front portion of the cylinder hole and the front half of the base portion.

2. The depression head for a pump according to claim 1, wherein a forward bias force of the second bias means is smaller than the forward bias force of the first bias means.

3. The depression head for a pump according to claim 1, further comprising a bed member having a sliding cylinder extending upwardly from a bed plate and fitted into the liquid conduit in a liquid-tight manner; and a lever member having one end coupled to a rear end portion opposite to the tip portion side of the base portion of the valve rod member, having another end contacting the bed plate, and an intermediate portion pivotably supported by the head body, wherein the bed member and the lever member are arranged so that when the head body is pressed down toward the bed member, the base portion of the valve rod member can be displaced backwardly by a rotation of the lever member.

4. The depression head for a pump according to claim 1, wherein a locking portion is formed in the front half of the base portion and a locked portion is formed in the cylinder hole of the tip portion, thereby locking the locking portion with the locked portion to integrally link the base portion and the tip portion; and a displacement margin is provided between a front end of the base portion and an inner portion of the cylinder hole.

5. A depression head type discharge pump, wherein a stem extends upwardly from a cylindrical piston sliding in a pump cylinder; a depression head according to claim 1 is mounted on an upper end of the stem; and a forward bias force of the second bias means is set so that the tip portion of the valve rod member releases from the valve seat in response to a pressure in the pump cylinder caused when the cylindrical piston is depressed while the tip portion of the valve rod member seals the valve seat when the cylindrical piston returns upwardly from a lowermost position.

6. The depression head for a pump according to claim 1, wherein the second bias means exerts an elastic force larger than a sum of a static friction resistance between the tip portion and the inner wall of the cylinder portion and a friction resistance of a content liquid when the tip portion is at a backmost position.

7. The depression head for a pump according to claim 1, wherein the tip portion may be turned back forward and outward from the rear edge of the cylinder body, so that the turned-back portion forms the large external diameter portion.

* * * * *